US005621448A

United States Patent [19]

Oelbrandt et al.

[11] Patent Number: 5,621,448

[45] Date of Patent: Apr. 15, 1997

[54] INK JET RECORDING METHOD

[75] Inventors: Leo Oelbrandt, Kruibeke; Luc Leenders, Herentals, both of Belgium

[73] Assignee: AGFA-Gevaert, N.V., Mortsel, Belgium

[21] Appl. No.: 444,294

[22] Filed: May 18, 1995

[30] Foreign Application Priority Data

Jul. 7, 1994 [EP] European Pat. Off. ..... 94201953

[51] Int. Cl.[6] ..... B41J 2/205; B41M 5/20

[52] U.S. Cl. ..... 347/96; 347/102; 347/105; 106/20 D

[58] Field of Search ..... 347/101, 96, 105, 347/100, 102; 106/20 D

[56] References Cited

U.S. PATENT DOCUMENTS

| | | | |
|---|---|---|---|
| 1,939,232 | 12/1933 | Sheppard et al. | 428/437 |
| 3,906,141 | 9/1975 | Anderson et al. | 347/96 |
| 4,266,229 | 5/1981 | Mahsukhani | 347/100 |
| 5,501,150 | 3/1996 | Leenders et al. | 101/466 |
| 5,568,173 | 10/1996 | Leenders et al. | 347/96 |

OTHER PUBLICATIONS

Sambucetti, et al., "Chemical Mist Printing", IBM Technical Disclosure Bulletin, vol. 20, No. 12, May 1978.

*Primary Examiner*—Valerie Lund
*Attorney, Agent, or Firm*—Breiner & Breiner

[57] ABSTRACT

A recording method comprising the consecutive steps of:

(1) image-wise projecting droplets of liquid, called ink, containing halide ions, onto a receiving material containing at least one substantially light-insensitive silver salt, said ink and/or receiving material containing at least one reducing agent for said silver salt, (2) uniformly photo-exposing said receiving material to form silver nuclei from silver halide obtained in step (1), and (3) heating said receiving material during and/or after said photo-exposure thereby forming a silver image in correspondence with the area wherein said ink has been deposited on said receiving material.

12 Claims, No Drawings

INK JET RECORDING METHOD

DESCRIPTION

1. Field of the Invention

The present invention relates to an ink jet recording method operating with an ink containing a component reactive with respect to a component contained in an ink-receiving recording material.

2. Background of the Invention

For a long time printing proceeded by pressure-contact of an ink-loaden marker or printing form with a receiving material, normally plain paper.

Nowadays a variety of non-impact printing systems has replaced to some extent classical pressure-contact printing. One of these non-impact printing systems is ink-jet printing.

In ink jet printing [ref. e.g. the book "Principles of Non Impact Printing" by Jerome L. Johnson (1986) Palatino Press, 18792 Via Palatino, Irvine Calif. 92715-U.S.A.] tiny drops of ink fluid are projected directly onto a receptor surface for printing without physical contact between the printing device and the receptor. The placement of each drop on the printing substrate is controlled electronically. Printing is accomplished by moving the print head across the paper or vice versa.

Different types of ink jet printing known as "continuous jet" and "drop-on-demand" are described in the above mentioned book of Jerome L. Johnson and in the book Imaging Processes and Materials—Neblette's Eight Edition, Edited by John Sturge et al, Van Nostrand Reinhold—New York (1989), p. 379–384.

Continuous ink jet printing is characterized by pressure-projecting ink through a nozzle to generate drops of ink directed in a continuous stream towards the ink receiving recording element passing meanwhile an image-wise modulated ink-deflection system allowing ink droplets of said stream to deposit image-wise on the recording element.

Drop-on-demand or impulse ink jet differs from continuous ink jet in that the ink supply is maintained at or near atmospheric pressure. An ink drop is ejected from a nozzle only on demand when a controlled excitation coming from acoustic pressure generated by piezoelectric element or from pressure generated by local electrothermal evaporation of liquid (thermal bubble-jet) is applied to an ink-filled channel ending in a nozzle.

As described in Journal of Imaging Technology, Vol. 15, Number 3, June 1989 by C. H. Hertz and B. A. Samuelson in their article "Ink Jet Printing of High Quality Color Images", p. 141, 20–40 drops of ink have to be applied to each pixel (elementary picture element) to ensure maximum color density within a commercially acceptable writing time. By drop-on-demand ink jet only one drop of ink is deposited per pixel in the image or no ink at all, i.e. drop-on-demand ink jet methods operate as on-off processes. In practice in order to made a record within an acceptable writing time drop-on-demand ink jet printing does not work with ink drops in superposition, and as a consequence thereof no optical densities of more than 2 can be obtained therewith owing to the small mass of each colored ink droplet and the limited concentration of colorant therein.

It would be a major improvement if ink jet printing could be used for producing images with increased optical density, say of more than 2 without droplet-superposition, or the number of superposed droplets could be reduced and yet high optical densities could be obtained.

In IBM Technical Disclosure Bulletin Vol. 23 No. 4 September 1980, W. T. Pimbley describes under the title "Leuco Dye System for Ink Jet Printing" that improved archival properties for ink used in ink jet printing can be attained by using leuco or vat dyes. Such dyes convert to their permanent form when oxidized. Accordingly, the record medium is first coated or impregnated with an oxidizing agent. Upon combining with the oxidant, the dyes convert to their permanent form, becoming insoluble and having high tinctorial strength and excellent archival properties, such as water fastness and light fastness. However, as in direct thermal recording materials based on the use of leuco dyes it is practically impossible to obtain optical densities higher than 2, certainly when applying drop-on-demand ink jet recording.

The classical photographic redox-system in which photo-exposed silver halide transforms in silver metal yields much higher optical densities, e.g. maximal optical density ($D_{max}$) of more than 4. However, the classical silver halide-emulsion layer materials require a wet processing and are associated with non-ecological waste liquids that have to be kept carefully out of the environment.

In dry thermography an organic substantially light-insensitive silver salt such as a silver soap is used in conjunction with a reducing agent that activated by heat is capable of reducing said silver compound.

According to U.S. Pat. No. 3,080,254 a typical heat-sensitive copy paper includes in the heat-sensitive layer a water-insoluble silver salt, e.g. silver stearate and an appropriate organic reducing agent, of which 4-methoxy-1-hydroxydihydronaphthalene is a representative. Localized heating of the sheet in the thermographic reproduction process, or for test purposes,by momentary contact with a metal test bar heated to a suitable conversion temperature in the range of about 90°–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. The heat-sensitive copying paper commercialized under the tradename THERMOFAX (3M Co.) is used in "front-printing" or "back-printing" as illustrated in FIGS. 1 and 2 of U.S. Pat. No. 3,074,809.

A more recent dry recording process is a photothermographic process that represents a combination between the silver halide system and thermography in that the imaging layer comprises the following main components:

(i) A comparatively small amount of silver halide, (ii) A major amount of non-light-sensitive image forming material that in the commercial photothermographic material DRY SILVER (3M Co.) consists of silver behenate (silver soap) and a reducing agent incorporated in a polymeric binder.

The components (i) and (ii) must be in working relationship by which is meant that the photolytic silver formed from the silver halide is capable of catalysing the image-forming redox reaction between the silver behenate and a therefor selected mild reducing agent so that heating the image-wise photoexposed layer for a few seconds to approximately 100° C. will develop a silver image in correspondence with the light image without producing substantial fog in the non-exposed areas.

A basic patent for said photothermographic process is U.S. Pat. No. 3,457,075 and corresponding UK patent 1,110,046.

An important disadvantage of the above described photothermographic material is its permanent photosensitivity whereby fog may be developed on post-exposure and heating.

OBJECTS AND SUMMARY OF THE INVENTION

It is an object of the present invention to provide a recording method operating with an ink jet in conjunction with an ink receiving material of particularly good shelf-life whereon substantially black images of high optical density, e.g. of at least 2, can be obtained with excellent archival properties and without problems of background fogging.

It is a special object of the present invention to provide an ink jet printing method having enlarged grey scale reproducing capabilities.

It is a further object of the present invention to provide an ink receiving material suited for use in combination with ink jet printing and having the above enumerated properties.

Other objects and advantages of the present invention will appear from the following description and examples.

In accordance with the present invention. a recording method is provided which method comprises the consecutive steps of:

(1) image-wise projecting droplets of liquid, called ink, containing halide ions, onto a receiving material containing at least one substantially light-insensitive silver salt, said ink and/or receiving material containing at least one reducing agent for said silver salt, (2) uniformly photo-exposing said receiving material to form silver nuclei from silver halide obtained in step (1), and (3) heating said receiving material during and/or after said photo-exposure thereby forming a silver image in correspondence with the area wherein said ink has been deposited on said receiving material.

Said reducing agent(s) is are capable of heat-activated reduction of said substantially light-insensitive silver salt(s) catalyzed by the silver nuclei that are formed in situ by the photo-exposure of the silver halide that has been obtained by reaction of said silver salt(s) with the halide ions applied by ink jet.

DETAILED DESCRIPTION OF THE INVENTION

A more detailed description will now be given of the ingredients of the ink receiving material and of the "inks" applied.

Substantially light-insensitive organic silver salts particularly suited for use in the above defined receiving material are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, and likewise silver dodecyl sulphonate described in U.S. Pat. No. 4,504,575 and silver di-(2-ethylhexyl)-sulfosuccinate described in published European patent application 227 141. Useful modified aliphatic carboxylic acids with thioether group are described e.g. in GB-P 1,111,492 and other organic silver salts are described in GB-P 1,439,478, e.g. silver benzoate and silver phthalazinone, which may be used likewise to produce a thermally developable silver image. Further are mentioned silver imidazolates and the substantially light-insensitive inorganic or organic silver salt complexes described in U.S. Pat. Nos. 4,260,677 and 5,240,809.

The coverage of said silver salt(s) in the ink-receiving material is preferably in the range of 1 g/m$^2$ to 10 g/m$^2$.

Reducing agents applied in said ink-receiving material may be mild reducing agents that on activation by heat will react with said light-insensitive silver salts with which they stand in working relationship.

By saying that the reducing agent(s) stand in thermal working relationship with the substantially light-insensitive silver salt(s) is meant that they may be present in the same or an adjacent layer but are capable to come on healing into reactive contact with the silver salt(s). So, according to an embodiment a hydrophilic binder layer covers the layer containing the silver salt(s), the layer containing said silver salt(s) being fairly hydrophobic but penetratable by organic watermiscible solvent(s), e.g. acetone, contained in the ink, and said reducing agent(s) are present in one or both of said layers.

Suitable mild reducing agents are e.g. 1-phenyl-3-pyrazolidinone (PHENIDONE) or derivatives thereof, stable hindered phenol reducing agents, e.g. bis-phenols such as "Ionol" (2,6-di-t-butyl-p-cresol) described in UK patent 1,451,403, U.S. Pat. Nos. 3,218,166, 3,547,648 and 5,260,180. Particularly useful reducing agents are p-sulfonamidephenol type compounds an example of which is p-phenylsulfonylaminophenol and described for colours formation in conjunction with four equivalent photographic colour couplers in U.S. Pat. No. 4,021,240. In U.S. Pat. No. 3,531,286 the use of photographic phenolic or active methylene colour couplers in conjunction with by heat activated p-phenylenediamine developing agents to produce dye images is disclosed.

Mild reducing agents such as reduced indoaniline leuco dyes that by oxidation through silver ions form a dye are described e.g. in U.S. Pat. Nos. 4,374,921 and 5,240,809. These leuco dyes are capable of forming a quinoidal dye on oxidation (ref. e.g. U.S. Pat. Nos. 4,022,617, 4,374,921, 4,460,681 and 4,780,010).

By using colour forming reducing agents either or not in combination with colour couplers dyes are formed that enhance the optical density obtained with the silver image and possibly improve the neutrality of its colour tone.

The reducing agent(s) present in the receiving material in conjunction with said light-insensitive silver salts are preferably present therein in an amount equivalent with the amount necessary for complete reduction of the silver compound in an area covered by an ink drop. The coverage of said reducing agent(s) in the ink-receiving material is preferably in the range of 0.3 g/m$^2$ to 3.0 g/m$^2$, but reducing agent(s) may be absent when the ink itself contains sufficient of them.

When contained in the ink the reducing agent may be a strong reducing agent and optionally the ink receiving material contains an auxiliary reducing agent having less reducing power as the mild reducing agents mentioned above. Relatively strong reducing agents are hydroquinone type reducing agents and p-methylamino-phenol.

In order to obtain a neutral black image tone in the higher densities and neutral grey in the lower densities the recording layer and/or the ink contains so-called toning agent known from thermography or photo-thermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446, 648 and 3,844,797. Other particularly useful toning agents are succinimides and the heterocyclic toner compounds of the benzoxazine dione or naphthoxazine dione type within the scope of following general formula:

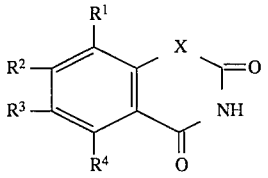

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkylgroups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic or cyclohexane ring. Toners within the scope of said general formula are described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat. No. 3,951,660.

The ink applied according to the present invention is preferably a water-based ink in which a compound providing halide ions is dissolved. By water-based ink is to be understood that the carrier liquid of the ink is water or a mixture of water with (a) water-miscible organic solvent(s), e.g. acetone, with the proviso that the halide compound and optionally present reducing agent(s) remain sufficiently dissolved or finely dispersed therein to avoid clogging of the ink jet nozzle(s). The water-based ink may contain all kinds of polymeric watersoluble compounds to control its viscosity, e.g. polyvinyl alcohol, (sodium) carboxymethyl cellulose and poly-N-vinylpyrrolidone.

Particularly suitable halide compounds for use in said ink are chloride and bromide compounds in which the halide ion is associated with a hydrogen ion, an alkali metal ion, e.g. $Na^+$ or $K^+$, alkaline earth metal ion, e.g. $Mg^{2+}$, tin or zinc ion or onium ion, e.g. ammonium cation or quaternary ammonium ion that may have surface active (wetting) properties.

According to a particular embodiment the ink has already a color by the presence of one or more colorants therein for further enhancing the optical density of the final image.

When the ink inherently has already an optical density by containing e.g. a blue or black colorant, the optical density of the deposited colorant(s) is added to the optical density of the silver obtained by reduction so that optical densities of more than 3 can be produced easily. For example, the optical density provided by the deposited colorant(s) is already in the range of 0.8 to 1.5.

A discussion of the formulation of colored water-based ink-jet inks and preferred properties thereof is given by Henry R. Kang in Journal of Imaging Science, Vol. 35, No. 3, May/June 1991, p. 179–201 and the already mentioned "Handbook of Imaging Materials", edited by Arthur S. Diamond, p. 537–540.

As described in the book imaging Information Storage Technology Edited by Wolfgang Gethartz—VCH Weinheim—New York—Basel—Cambridge (1992) under the heading "1.13. Ink-jet printing" many of the commercially available ink-jet printers operate with water-based ink (see p. 43 of said book) by which is meant that such inks contain more than 70% by weight of water. Small amounts of humectants such as glycols are added to reduce the evaporation rate and for continuous ink-jet printing the ink contains some salt in order to obtain a required electrical conductivity and chargeability for electrostatic droplet deflection. Such salt may be a halide salt suited for use in the recording method according to the present invention.

The concentration of the halide compound in the ink is preferably in the range of 0.05 mole/l to 5.0 mole/l.

Water-based inks for use according to the present invention may contain for the major part (more than 50% by volume) a water-miscible solvent such as acetone, ethanol and methanol.

Inks containing a major amount of organic solvent(s) and that are particularly suited for use in thermal ink-jet printers (a type of drop-on-demand ink jet printers) are described in detail in published European patent application 0 413 442. The solvents used have boiling points from about 50° C. to about 200° C. and are e.g. members of the following group: alkyl glycol ethers, wherein the alkyl group has up to 4 carbon atoms, alkyl pyrrolidinones, ketones and lactones.

According to a special embodiment inks of different halide-concentration and/or different concentration of reducing agent(s), optionally containing different concentrations of colorant(s) are applied image-wise from different nozzles. The ink expulsion of the different nozzles is actuated in such a way that ink drops stemming from one nozzle produce ink spots with different optical density with regard to another nozzle, hereby the gradation of the images is controllable without having to rely on dithering techniques and superposition of ink droplets.

The halide ions deposited by inkiet react with the silver ions of the silver source present in the imaging layer and form in situ photo-sensitive silver halide which by exposure to actinic electromagnetic radiation (ultraviolet and/or visible light) yields silver nuclei that catalyse the reduction of the reducible silver source by the thermally activatable reducing agent(s) being or brought into working relationship therewith.

The photo-sensitive silver halide is preferably formed in an amount of 1 to 25 mole % based upon the total weight of the silver content in the ink receiving (imaging) layer.

In order to obtain catalytic relationship of the redox reactants (silver source and reducing agent) with the formed silver nuclei it is important that the halide ions can penetrate into the binder layer (imaging layer) containing the silver source. Thus, the ink-image receiving material contains the substantially light-insensitive organic silver salt (silver source) preferably together with the necessary reducing agent(s) in a film-forming binder that is permeable for the "ink" and also for the reducing agent(s) in dissolved state.

Suitable polymeric binders for the imaging layer are e.g. cellulose derivatives such as ethylcellulose, cellulose esters, carboxymethylcellulose, starch ethers, partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral being soluble in acetone that may be present in relatively high amount in a water-based ink. Polyvinyl butyral containing some vinyl alcohol units is marketed under the trade name BUTVAR B79 of Monsanto U.S.A.

In the ink receiving layer being at the same time the imaging layer the binder to organic silver salt weight ratio is preferably in the range of 0.2 to 6, and the thickness of that layer is preferably in the range of 5 to 16 μm.

The above mentioned polymers or mixtures thereof forming the binder may be used in conjunction with waxes or "heat solvents" also called "thermal solvents" or "thermo-solvents" improving the diffusion of the reducing agent(s) and/or of the halide compound, and enhancing the reaction speed of the radox-reaction at elevated temperature.

By the term "heat solvent" in this invention is meant a non-hydrolyzable organic material which is in solid state at temperatures below 50° C. but becomes on heating above that temperature a plasticizer for the binder of the layer wherein they are incorporated and possibly act then also as a solvent for at least one of the redox-reactants, e.g. the reducing agent for the organic silver salt. Useful for that purpose are compounds having a dielectric constant of at least 10. Particularly useful are polyethylene glycols having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1, 1-dioxide, methyl anisate and 1,10-decanediol being described as heat solvents in Research Disclosure, December 1976, (item 15027) pages 26–28. Still other examples of heat solvents have been described in U.S. Pat. Nos. 3,438, 776, and 4,740,446, and in published EP-A 0 119 615and 0 122 512 and DE-A 3 339 810.

Heat-solvents may be used likewise in the ink-jet liquid, especially when they are water-soluble and can act as moistening agent for the organic water-insoluble binder layer wherein the organic silver salt is coated and improve the penetration of the halide compound in said layer bringing about a much faster reactive contact with reducible organic silver salt.

The layer containing the organic silver salt is commonly coated from an organic solvent containing the binder in dissolved form.

In order to shorten the drying time, surface-active agents may be present in the imaging layer. Surface-active agents, and substances called penerrants improve the take up of the ink in the ink receiving material. Further are mentioned antistatic agents, e.g. non-ionic antistatic agents including a fluorocarbon group as e.g. in $F_3C(CF_2)_6CONH(CH_2CH_2O)$—H, plasticizers, friction reducing compounds e.g. in the form of particles protruding from the recording layer, e.g. talc particles and polymer beads with low friction coefficient, and transparent inorganic pigments, e.g. colloidal silica.

According to a particular embodiment associated with the use of a "water-based ink" in conjunction with a poorly water-permeable imaging layer containing said substantially light-insensitive organic silver salt, the imaging layer is over-coated with a hydrophilic colloid layer capable of rapidly absorbing a water-based ink-jet ink containing the already mentioned halide ions.

Hydrophilic colloid layers suited for said purpose preferably contain organic polymeric hydrophilic colloids known as binding agent in silver halide emulsion layer materials, e.g. gelatin and such polymers that can be applied from an aqueous solution and may be hardened up to a certain degree without destroying their permeability with respect to aqueous liquids. A survey of such binders is given in Research Disclosure November 1989, item 307105 in the chapter IX. "Vehicles and vehicle extenders" and for suitable hardening agents reference is made to chapter X. "Hardeners".

Preferred hydrophilic colloids for coating an outermost hydrophilic water-permeable layer are protein-type polymers such as gelatin, casein, collagen, albumin, or gelatin derivatives, e.g. acetylated gelatin. Further suitable water-soluble binding agents are: polyvinyl alcohol, polyvinyl pyrrolidone, dextran, gum arabic, zein, agar-agar, arrowroot and pectin.

According to a particular embodiment said outermost hydrophilic layer may contain finely divided (colloidal) optically transparent inert pigments having a hydrophilic character, such as transparent colloidal silica not masking the silver pattern formed underneath.

According to another embodiment said outermost hydrophilic water-permeable layer contains opaque white light or colored light reflecting pigments masking the silver image, but in that case the support of the imaging layer is transparent and the therein formed silver image visually inspectable therethrough.

According to still another embodiment said outermost hydrophilic colloid layer contains coating aids and matting agents and antistatic agents, e.g. of the type described in the above mentioned Research Disclosure.

Preferably, after receiving the aqueous liquid droplets containing said halide ion providing compound the receiving material is exposed to actinic electromagnetic radiation and simultaneously and/or thereupon heated, e.g. in the range of 60° to 120° C. to enhance the redox-reaction speed and formation of the silver image.

Heat may be supplied by means of a hot body, e.g. hot metal roller, contacting the ink-receiving material or may be supplied in the form of hot air, e,g. in a ventilated drying oven, and/or may be supplied in the form of radiant heat.

Radiant heating may proceed with flash lamp, e.g. xenon gas discharge lamp, incandescent infra-red light lamp or by means of laser beam.

The exposure of silver halide formed in situ in the imaging layer may proceed with any kind of light source emitting "actinic" electromagnetic radiation which is radiation having a photolytic effect on said silver halide. Said exposure may proceed simultaneously with said heating and/or prior thereto.

The coating of the above mentioned optional outermost layer and of the imaging layer containing the organic silver salt may proceed by any coating technique known in the art e.g. as described in said Research Disclosure and in "Modern Coating and Drying Technology", edited by Edward D. Cohen and, Edgar B. Gutoff, (1992) VCH Publishers Inc. 220 East 23rd Street, Suite 909 New York, N.Y. 10010, U.S.A.

The imaging layer is coated preferably on a support being a thin sheet or weblike carrier material that should be stable preferably at heating temperatures of between 60° and 160° C. For example, the support is made from paper, polyethylene coated paper or transparent resin film, e.g. made of a cellulose ester, e.g. cellulose triacetate, polypropylene, polycarbonate or polyester, e.g. polyethylene terephthalate. The support may be subbed if need be to improve the adherence thereof of the layer containing said silver salt.

The imaging method according to the present invention can be used for both the production of transparencies and reflection type prints. Such means that the support will be transparent or opaque, e.g. having a white light reflecting aspect. For example, a paper base is present which may contain white light reflecting pigments, optionally also applied in an interlayer between the recording layer and said base. In case a transparent base is used, said base may be colorless or colored, e.g. has a blue colour, of normal use in medical silver halide emulsion film.

In the hard copy field imaging materials have normally a white opaque base, whereas in the medical diagnostic field black-imaged transparencies find wide application in inspection techniques operating with a light box.

The following example illustrates the present invention. The percentages, parts and ratios are by weight unless otherwise indicated.

EXAMPLE

Preparation of ink receiving material

On a subbed polyethyleneterephthalate support having a thickness of 100 μm was coated from methyl ethyl ketone as coating vehicle an ink receiving imaging layer containing after coating and drying the following ingredients:

| | |
|---|---|
| silver behenate | 4.42 g/m$^2$ |
| polyvinyl butyral [BUTVAR B79 - tradename) | 4.42 g/m$^2$ |
| 3,4-dihydro-2,4-dioxo-1,3,2H-benzoxazine | 0.34 g/m$^2$ |
| BAYSILONE Öl A (tradename) | 17 mg/m$^2$ |

Composition of the ink

| | |
|---|---|
| aqueous 50% sodium bromide solution | 1 part |
| 30% solution in acetone of reductor S | 2 parts |

Reductor S is a sulfonamide corresponding to the following structural formula:

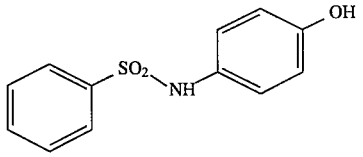

Ink jet printing

The ink reservoir of the ink-cassette of the MANNESMANN TALLY-printer (tradename) type MT92 (drop-on-demand type ink jet printer) was filled with the above defined ink, Modulated by an electronically stored test-pattern "ink jet" printing of a solid square area measuring 10 mm×10 mm was carried out onto the above prepared ink image receiving material.

Following said ink deposition the ink receiving material was exposed for 1 min with a 2000 W high-pressure mercury-vapour tube containing iron (III) chloride as dopant, hereby forming silver nuclei from the silver bromide being formed in situ in the imaging layer.

After said overall photo-exposure part of the ink receiving material was heated through its rear side by pressing it for 10 seconds against an aluminum block internally electrically heated at a temperature of 118° C.

The minimum and maximum optical densities of the non-heated (A) parts and of the heated (B) parts of the ink receiving layer having received the above defined ink were measured through ortho filter with MacBeth TD 904 densitometer.

The measured minimum densities (Dmin) and maximum densities (Dmax) are listed in the following Table 1.

TABLE 1

| Part | Dmin | Dmax |
|---|---|---|
| A | 0.07 | 0.07 |
| B | 0.07 | 3.1 |

We claim:

1. A recording method comprising the consecutive steps of:

(1) image-wise projecting droplets of liquid, called ink, containing halide ions, onto a receiving material containing at least one substantially light-insensitive silver salt, said ink and/or receiving material containing at least one reducing agent for said silver salt, (2) uniformly photo-exposing said receiving material to form silver nuclei from silver halide obtained in step (1), and (3) heating said receiving material during and/or after said photo-exposure thereby forming a silver image in correspondence with the area wherein said ink has been deposited on said receiving material.

2. Recording method according to claim 1, wherein the halide ions stem from a chloride or bromide compound in which the halide ion is associated with a hydrogen ion, an alkali metal ion, alkaline earth metal ion, tin or zinc ion or onium ion.

3. Recording method according to claim 1, wherein said halide ions are applied by ink jet printing to said receiving material from an ink that is colored already before deposition on said receiving material.

4. Recording method according to claim 1, wherein said ink and/or said receiving material contains a toning agent.

5. Recording method according to claim 1, wherein inks of different halide-concentration and/or different concentration of reducing agent(s), optionally containing different concentrations of colorant(s) are applied image-wise from different nozzles, the ink expulsion of the different nozzles being actuated in such a way that ink drops stemming from one nozzle produce ink spots with different optical density with regard to another nozzle.

6. Recording method according to claim 1, wherein said substantially light-insensitive silver salt is an organic silver salt.

7. Recording method according to claim 6, wherein said substantially light-insensitive silver salt is a silver salt of an aliphatic carboxylic acid known as fatty acid, wherein the aliphatic carbon chain has at least 12 C-atoms.

8. Recording method according to claim 1, wherein a hydrophilic binder layer covers a layer containing said silver salt(s), the layer containing said silver salt(s) being fairly hydrophobic but penetratable by organic watermiscible solvent(s) contained in the ink, and wherein said reducing agent(s) are present in one or both of said layers.

9. Recording method according to claim 1, wherein said reducing agents are selected from the group consisting of 1-phenyl-3-pyrazolidinone including derivatives thereof, bis-phenols, p-sulfonamide-phenol type compounds, and leuco dyes that are capable of forming a quinoidal dye on oxidation.

10. Recording method according to claim 1, wherein said reducing agent(s) are present in the receiving material in conjunction with said light-insensitive silver salts in an amount equivalent with the amount necessary for complete reduction of the silver compound in an area covered by an ink drop.

11. Recording method according to claim 10, wherein the coverage of said reducing agent(s) in the ink-receiving material is in the range of 0.3 g/m$^2$ to 3.0 g/m$^2$.

12. Recording method according to claim 1, wherein said ink is a water-based ink containing a mixture of water with (a) water-miscible organic solvent(s).

* * * * *